United States Patent [19]

Wolters et al.

[11] 4,009,856

[45] Mar. 1, 1977

[54] MECHANISM FOR TILTING CHAIRS

[75] Inventors: Richard H. Wolters, Grand Rapids, Mich.; William E. Stumpf, Winona, Minn.

[73] Assignee: Herman Miller, Inc., Zeeland, Mich.

[22] Filed: Jan. 13, 1976

[21] Appl. No.: 648,812

[52] U.S. Cl. ..... 248/382; 248/375; 248/381; 248/397

[51] Int. Cl.[2] ..... A45D 19/04; A47J 47/16

[58] Field of Search ..... 248/371–375, 248/378–385, 397; 297/301–305, 325–328

[56] References Cited

UNITED STATES PATENTS

| | | | |
|---|---|---|---|
| 398,293 | 2/1889 | Tyler | 248/382 |
| 555,694 | 3/1896 | Gilson | 248/380 |
| 2,558,049 | 6/1951 | Hersey et al. | 248/384 X |
| 3,480,249 | 11/1969 | Lie | 248/373 |

*Primary Examiner*—Lawrence J. Staab
*Attorney, Agent, or Firm*—Price, Heneveld, Huizenga & Cooper

[57] ABSTRACT

A tilting chair support mechanism is provided including a spindle support, a pivotally mounted tilt plate and a spring acting between the support and the tilt plate biasing the plate into a forwardly tilted position. A stop latch carried on the tilt plate cooperates with one of a pair of socket-like stop shoulders on the rear face of an upstanding, spindle mounted stop finger whereby the maximum forwardly tilted position of the plate can be selectively adjusted depending upon the character of the user's activities while seated.

12 Claims, 6 Drawing Figures

MECHANISM FOR TILTING CHAIRS

CROSS REFERENCE TO RELATED APPLICATION

This application is related to patent application Ser. No. 648,793, filed on Jan. 13, 1976 by Richard H. Wolters and assigned to the assignee of this application. Richard H. Wolters is the inventor of the specific means for providing a resilient, forwardly tilting bias to the tilt plate. The claimed subject matter of this application is the means by which the tilt plate can be optionally limited by the user to either of two maximum forwardly tilted positions.

BACKGROUND OF THE INVENTION

This invention relates to tiltable chair arrangements and, more particularly, it concerns a spring biased tilt mechanism disposed between a support base and the bottom of a chair.

Known prior tilt mechanisms, irrespective of the type of means by which return bias is generated such as torsion bar, rubber pack or coil spring variety provide only one, standard initial position. As a result, chairs incorporating such devices do not function effectively for special purposes. For example, a chair designed primarily for reading purposes or for use in the living room of a home, does not provide a sufficient forward lean positon to adapt it for typing purposes. A need exists for a single tilt device capable of providing both a standard initial position and a special forward tilt position readily adapting the chair to special uses such as typing, drafting, laboratory use, etc., where a forward or more erect posture is desirable. Further, such a feature would permit a manufacturer to produce only one tilt mechanism for incorporation into a full line of chairs or seats.

SUMMARY OF THE INVENTION

In accordance with the present invention, an improved tilt mechanism for a chair is provided possessing the qualitities of compactness, adaptability to a wide variety of the population and to different uses, smoothness of operation, ease of maintenance, ease of adjustment, long life and relatively low cost. Essentially, the tilt mechanism of the present invention includes a tilt plate pivotally supported on a support spindle or post. The support spindle includes a trifurcated end, the forks of which are formed with apertures through which a pivot pin extends and upon which the tilt plate is pivotally supported.

The tilt plate includes a centrally disposed, longitudinally extending slot. The center prong or fork of the trifurcated post extends upwardly through the slot and serves as a stop finger. The stop finger is formed with an upper and a lower stop socket on one face. A pivotable latch carried by the tilt plate cooperates with the stop finger to provide dual initial positions for the tilt mechanism.

Among the object of the present invention therefore are: the provision of an improved tilt mechanism for a chair possessing simplicity and compactness and capable of adjustment from a standard initial position to a special, forward tilt position readily adapting the chair to special uses such as typing, drafting, laboratory use, etc., which require the user of a chair to assume a forward or erect posture position.

DETAILED DESCRIPTION OF THE PREFERRED EMBODIMENT

Figure 2:
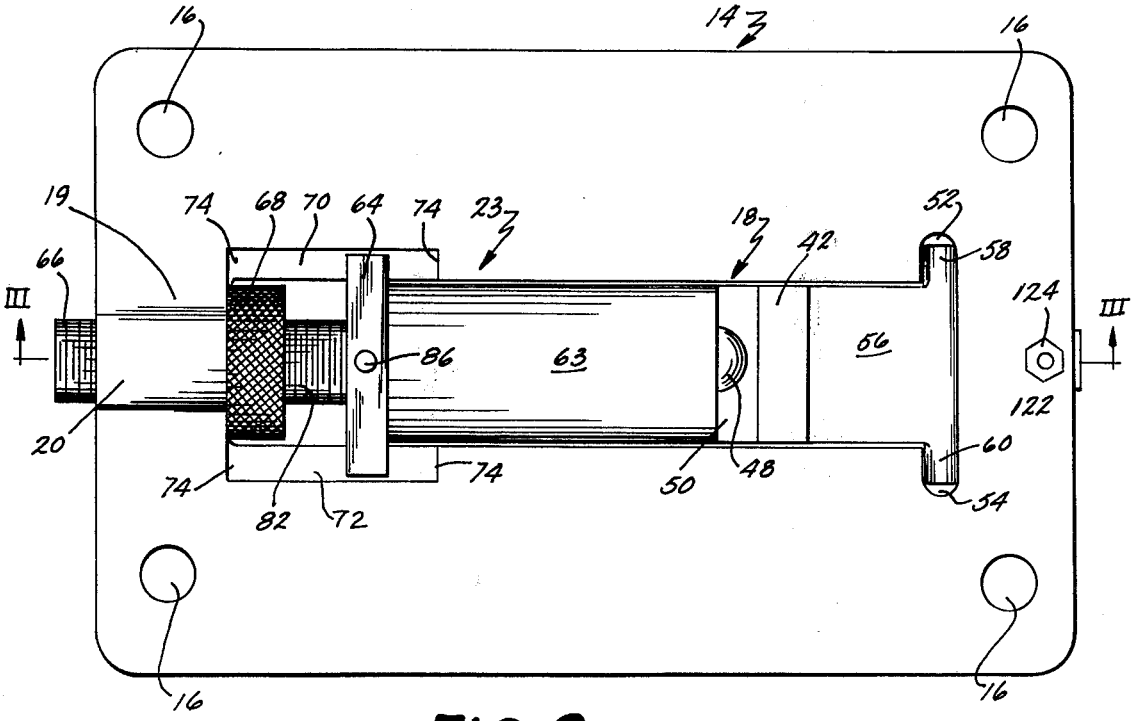
FIG. 2 is a plan view of the tilt mechanism in accordance with the present invention.

The preferred embodiment of a chair tilting mechanism in accordance with the present invention is illustrated in the drawings and designated generally by the reference numeral 10. As shown, the tilting mechanism includes a spindle support or post 12. A tilt plate 14 is pivotally connected to the post 12. The tilt plate includes apertures 16 which serve as attachment points to the underside of a chair or seat (not shown). As best seen in FIG. 2, the tilt plate 14 is formed with a centrally disposed, longitudinally extending slot 18. The forward end of the slot 18 is closed by the cross bar 19. The cross bar, at its center is provided with a fore and aft extending tubular portion 20 providing the clearance opening 22 (FIGS. 3 and 4) having a centerline which is coaxially aligned with the centerline of the longitudinal slot 18. A return torque imparting component 23 is disposed between the post 12 and the tilt plate 14, as more fully described below.

Figure 1:
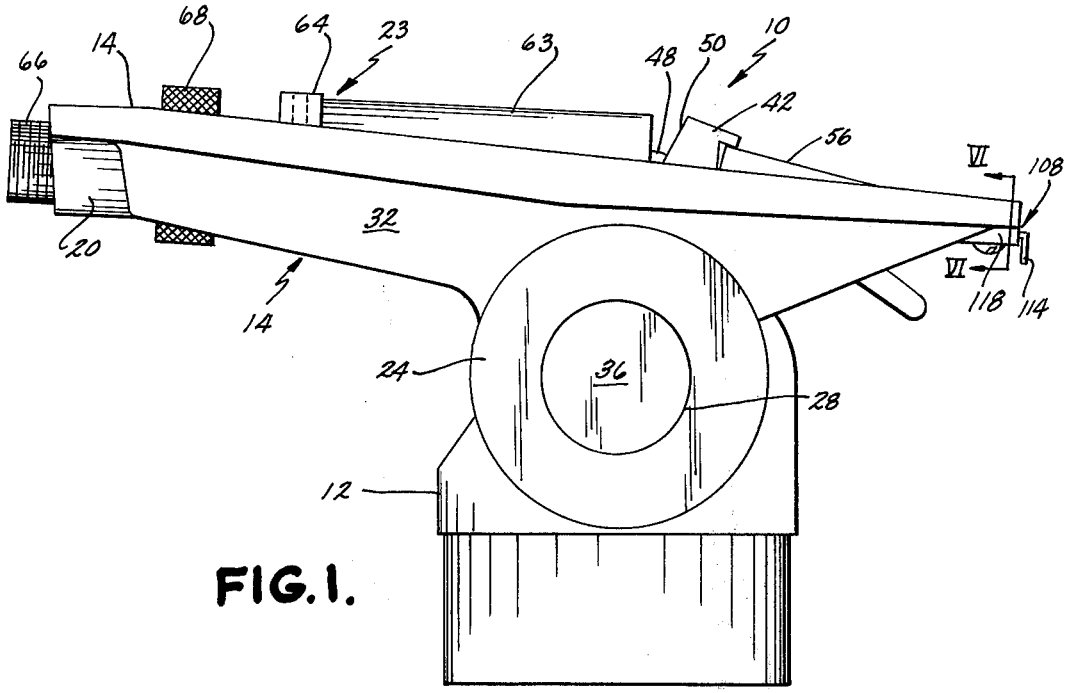
FIG. 1 is a side elevational view of the tilt mechanism in accordance with the present invention.
Figure 3:
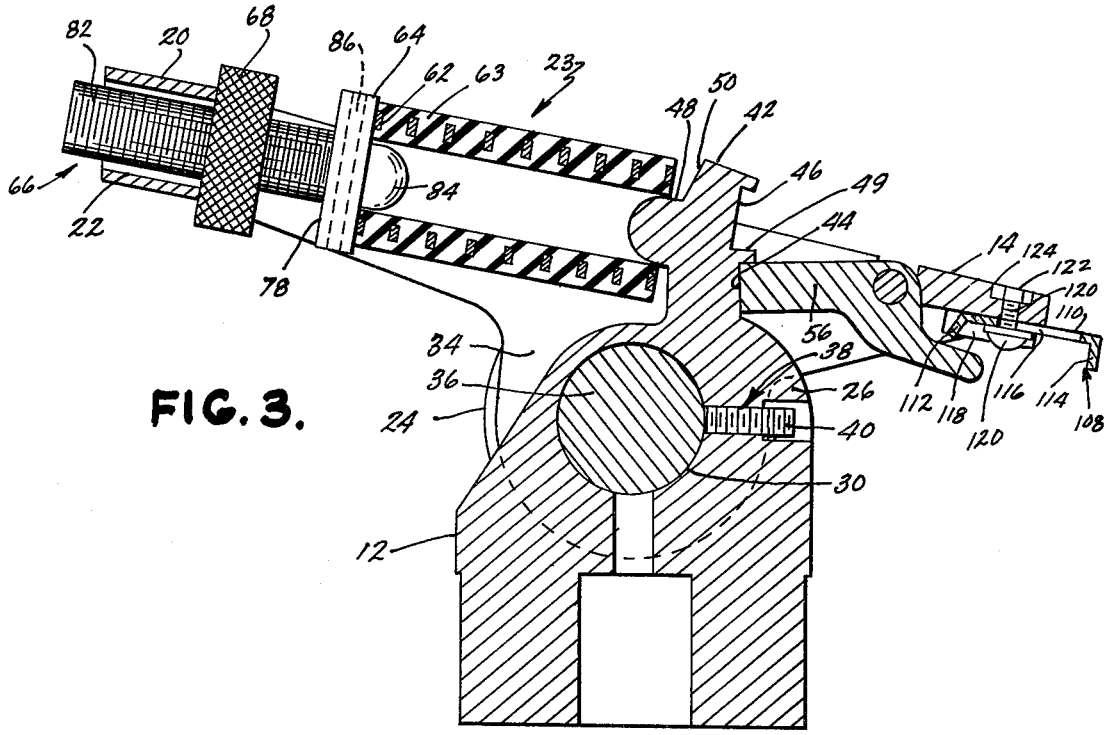
FIGS. 3 and 4 are cross-sectional views taken along line III—III of FIG. 2 showing the mechanism in the standard and special initial positons, respectively.
Figure 4:
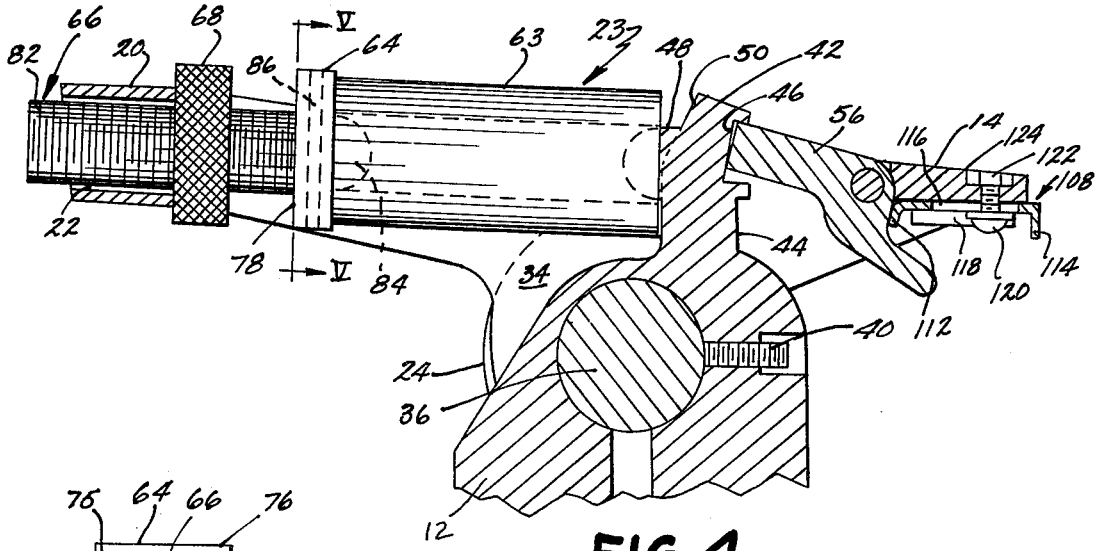

As best seen in FIGS. 1, 3 and 4, the support spindle or post 12 is trifurcated at its upper end to define outer pivot pin supports 24 and an intermediate pivot pin support arm 26. Each outer pivot pin support trunnion 24 has an aperture 28 formed therein and the intermediate pivot pin support has an aperture 30 formed therein.

The tilt plate 14 includes a yoke structure 32 on its underside. The tilt plate yoke 32 includes a pair of spaced depending hinge ears or webs 34 having apertures formed therein. A pivot pin 36 extends through webs 34 and is supported by the outer pivot pin support trunnions 24 and the intermediate pivot pin support arm 26 of the post 12. The yoke 32 and the tilt plate 14 is thereby pivotally supported on the trifurcated spindle support or post 12. The support arm 26 is provided with an internally threaded bore 38 adapted to receive a set screw 40. The set screw 40 locks the pivot pin 36 against both rotational and axial movement with respect to the post 12.

As best seen in FIGS. 3 and 4, the support arm 26 includes an integral, upstanding stop finger 42. The stop finger extends upwardly through the longitudinal slot 18 of the tilt plate 14. The rear face of the stop finger is provided with a lower, standard position stop socket 44 and an upper, special, forward tilt or erect position stop socket 46. The two sockets are separated by a rearwardly extending wall 49. The forward face of the stop finger 42 includes a centrally disposed, semispherical boss or projection 48. Further, the upper portion 50 of the forward face of the stop finger 42 is upwardly and rearwardly inclined or beveled with the bottom of the bevel being approximately at the center of the boss (FIGS. 3 and 4).

As seen in FIG. 2, the rear end of the longitudinal slot 18 of the tilt plate 14 is formed with semi-cylindrical, latch pin slots 52 and 54. These slots open through the upper face of the plate. A stop and release latch 56 having pins 58 and 60 is pivotally supported on a tilt plate 14 with the pins seated in the slots 52 and 54. As a result, the forward end of the latch 56 may be positioned so as to enter either the standard position stop socket 44 or the special position stop socket 46 in the rear face of the stop finger 42. This is best seen in FIGS. 3 and 4, respectively. As shown, when the stop latch 56 abuts either of the stop sockets 44 or 46, further counterclockwise rotational or forward pivotal movement of the tilt plate 14 is prevented.

Figure 6:
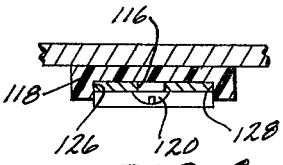
FIG. 6 is a fragmentary sectional view taken along the plane VI—VI of FIG. 1.

As best seen in FIGS. 2, 3 and 6, a slidable latch retainer assembly 108 is secured to the underside of the tilt plate 14 adjacent the rear edge thereof. This latch retainer insures that the latch 56 engages the special socket 46 upon return movement from a tilted position and when shifted permits the latch to pivot under its own weight to the standard position.

The retainer assembly includes a slidable member 110 having depending front and rear tabs 112, 114, respectively. The member 110 is formed with a centrally disposed, elongated slot 116. A guide block 118 secured to the tilt plate and having depending sides 126 and 128 prevents sideways movement of the tabbed member 110. A bolt 120 extending through slot 116 slidably secures the member 110 to the tilt plate. A nut 122 threads to the bolt within countersink 129. In the alternative, a headed pin could be used to slidably mount the member 110 to the tilt plate.

As shown in FIG. 3, when the normal position is desired, the user merely grasps tab 114 and slides the member 110 outwardly, permitting the latch 56 to assume its lower socket engaging position. The latch will rotate to this position under the action of gravity. When the forward tilt position is desired, member 110 is pushed in, as shown in FIG. 4, thereby preventing rotation of the latch 56.

When the latch 56 abuts the standard position stop socket 44, the tilt plate 14 assumes the rearwardly inclined position illustrated in FIG. 3. However, when the stop latch 56 engages the special position stop socket 46, the tilt plate is permitted to rotate forwardly thorugh a greater angle, as shown in FIG. 4. This dual position feature of the chair tilting mechanism, permits the chair to be readily adapted for special or specific uses as typing, drafting or laboratory use, or any use requiring a person to assume a more erect position. This feature obviates the need for employing different tilt mechanisms in chairs or seats manufactured for such special or specific uses. This feature also permits the same chair to be adapted to both types of uses, those requiring an erect posture and those requiring a tilted posture. The changeover can be made almost instantly. This feature also results in a reduction in manufacturing costs since a manufacturer may employ a modular approach utilizing the same chair tilting mechanism with different chairs and bases.

Figure 5:
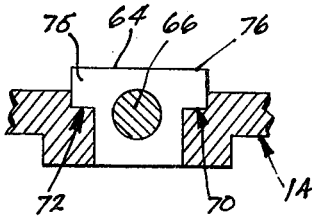
FIG. 5 is a fragmentary sectional view taken along the line V—V of FIG. 4.

The return torque imparting component 23 employs a coil spring 62, encapsulated by a plastic material 63, a spring support block 64, an adjustment shaft or compression stud 66, and a knurled, spring preload, adjustment nut 68. A pair of tracks or guides 70 and 72 are formed in the tilt plate 14 at the forward end of the longitudinally extending slot 18 (FIG. 2). Both tracks 70 and 72 have abutment surfaces 74 at each end. The spring support block 64 is generally T-shaped and dimensioned so that the ears 75 and 76 of the block 64 rest on tracks 70 and 72 (FIG. 5). The support block is, therefore, retained against rotational movement about its longitudinal axis by the tilt plate 14. Longitudinal movement is limited by the abutment surfaces 74. Further, the support block 64 is formed with a longitudinally extending aperture 78 in its depending leg.

The adjustment shaft 66 includes a threaded portion 82 with a smooth, rounded nose portion 84 at its rearward end. The adjustment shaft 66 is disposed within the clearance opening 22 and passes through the opening 22. The nose 84 projects rearwardly beyond the support block 64. A vertical pin 86 (FIGS. 2 and 4) secures the support block to the adjustment shaft. This arrangement holds the adjustment shaft against rotation and prevents axial movement of the shaft relative to the support block.

The knurled adjustment nut 68 is threadably disposed on the adjustment shaft 66 with its forward face seated against the cross bar 19. As a result, rotation of the adjustment nut 68 is converted into longitudinal movement of the adjustment shaft 66. This permits preloading of the coil spring 62 since it is confined between the spring support block 64 and the stop finger 42. The coil spring 62 is of the linear reaction type having flattened ends. It is embedded in a matrix of compressible, fatigue resistant plastic. A suitable plastic for this purpose is a urethane having a Durometer of Shore A 85, a 100% modular at 800 p.s.i., a 300% modular at 2000 p.s.i., an elongation of 570% and a tensile strength of 6000 p.s.i. The result is a tubular member in which only the coils are enclosed, the center being open. An exemplary spring suitable for use with this invention is one of 0.100 inch thick flat wire formed into 6 active coils of 1 inch O.D. and ½ inch I.D. forming a spring 2.45 inches long.

The projection 48 of the stop finger is seated in the end of the plastic encapsulated spring 62 and serves as a pivot point about which the spring 62 rocks as the tilt plate is pivoted. The beveled portion 50 of the stop finger 42 provides clearance for the end of the coiled spring 62 during this rocking movement.

The initial preload of the plastic encapsulated coil spring 62 may be readily adjusted by rotation of the knurled nut 68. The construction of this invention permits the preload to be adjusted within the range of 100–550 inch pounds. This permits a specific coil spring to be adapted to a wide range of different weights possessed by different people using the seat. By varying the initial preload, many people are able to adjust the chair to provide for them a smooth, comfortable ride on the chair. At full 15° tilt, the spring can exert a resistance of 400 to 1300 inch pounds.

The overall structural arrangement of the tilting mechanism is compact and has a pleasing exterior appearance. Due to the fact that the coil spring is encapsulated with a plastic material 63, the unsightliness of an exposed coil spring is avoided. Further, the plastic material 63 forms a smooth surfaced tube which is easily cleaned and is not prone to the collection of dust and dirt as are conventional springs. Occupying the space between the coils of the plastic positively prevents anyone from getting his fingers crushed between the coils.

The mechanism of the present invention permits ready adaptability to normal and special use functions as well as being capable of accommodating people of varying weights. By providing dual maximum forward tilt positions which can be easily and quickly changed by the user, the mechanism adapts the chair to interchangeable uses. This interchangeability eliminates the necessity of providing different mechanisms for different uses, not only a convenience to the user but a significant contribution to cost reduction. Thus, it will be appreciated that the present invention provides a tilting mechanism for a chair possessing the qualities of compact size, low weight, relatively low cost, as well as ease of adjustment and maintenance. It is expressly intended that the foregoing description is illustrative of the preferred embodiment only and is not to be considered limiting. The true spirit and scope of the present invention will be determined by reference to the appended claims.

The embodiments of the invention in which an exclusive property or privilege is claimed are defined as follows.

1. A tilting chair support mechanism having a support spindle and a seat mounting plate pivotally mounted to the top of said spindle; a spring resiliently urging said plate into a forwardly tilted position; means for limiting the forward tilting movement of said plate, the improvement in said means comprising: a stop on one of said plate and said spindle and a stop engaging latch on the other thereof; said stop having first and second latch engaging walls at different radial spacings from the axis of pivotal attachment of said plate and spindle whereby the forward pivotal movement of said plate is limited at a different position when said latch engages one of said walls than when it engages the other thereof; means mounting said latch for transfer from engagement with one of said walls to engagement with the other thereof.

2. A tilting chair support mechanism as described in claim 1 wherein said stop is rigidly secured to said spindle and said latch is mounted on said plate.

3. A tilting chair support mechanism as described in claim 2 wherein said stop is an upstanding finger and said latch engaging walls are on the rear surface thereof and are arranged one above the other.

4. A tilting chair support mechanism as described in claim 3 wherein said latch mounting means is a pivot having a horizontal axis whereby said latch may be shifted from one latch engaging wall to the other.

5. A tilting chair support mechanism as described in claim 4 wherein a retainer is mounted in said plate for locking said latch in engagement with said stop in one of its two wall engaging positions.

6. A tilting chair support mechanism comprising:

a support spindle;

a seat mounting plate pivotally mounted to the top of said spindle;

a spring resiliently urging said plate into a forwardly tilted position;

means for limiting the forward tilting movement of said plate, the improvement in said means comprising:

an upstanding finger rigidly secured to the top of said spindle;

said finger having a pair of rearwardly opening pockets arranged in spaced relationship to each other at different radial spacings from the axis of pivotal mounting of said plate of said spindle;

a latch and means pivotally mounting said latch to said plate for vertical swinging movement between a first position aligned with one of said pockets and a second position aligned with the other of said pockets whereby the maximum forwardly tilted position of said plate can be adjusted by shifting said latch from one of said pockets to the other thereof.

7. A tilting chair support mechanism as described in claim 6 wherein a manually operable retainer is provided for locking said latch against swinging movement in one of its said positions.

8. A tilting chair support mechanism as described in claim 7 wherein said retainer is a member slidably mounted to the lower surface of said plate rearwardly of said latch.

9. A tilt mechanism for mounting a seat, said mechanism having a base member and seat attachment member and pivot means pivotally securing said seat attachment member to the top of said base member, means providing resilient resistance to rearward pivotal movement of said seat attachment member, means for limiting forward tilting movement of said seat attachment member, said limiting means comprising: a latch secured to said seat attachment member; a stationary boss on said base member projecting upwardly therefrom through said seat attachment member and outwardly from and rearwardly of said pivot means, said boss having a pair of latch engaging sockets, said sockets being spaced apart radially of said pivot means whereby engagement of said latch with one of said sockets will limit forward pivotal movement of said seat attachment member about said pivot means at a different angle of tilt than engagement of said latch with the other of said sockets.

10. A chair tilting mechanism as defined by claim 9 wherein said latch is pivotally supported on said seat attachment member rearwardly of said pivot means and said sockets are in the rear face of said boss.

11. A chair tilting mechanism as defined by claim 10 wherein said limiting means further includes a slidable latch retainer means secured to said seat attachment member for preventing rotation of said latch from its socket engaging position when the seat attachment member is in its forward tilt position.

12. A chair tilting mechanism as defined by claim 9 wherein said limiting means includes: a guide block secured to said seat attachment member adjacent the rear edge thereof and in line with said latch; a slidable member having an elongated central slot and forward and rearward depending tabs; and means extending through said central slot for slidable securing said member within said guide block to said tilt plate.

* * * * *